US005633907A

United States Patent [19]

Gravelle et al.

[11] Patent Number: 5,633,907

[45] Date of Patent: May 27, 1997

[54] X-RAY TUBE ELECTRON BEAM FORMATION AND FOCUSING

[75] Inventors: Stephen W. Gravelle, Mequon; Steven D. Hansen, Port Washington; Karl F. Sherwin, Waukesha, all of Wis.

[73] Assignee: General Electric Company, Milwaukee, Wis.

[21] Appl. No.: 619,386

[22] Filed: Mar. 21, 1996

[51] Int. Cl.[6] ..... H01J 35/06

[52] U.S. Cl. ..... 378/121; 378/136; 378/138

[58] Field of Search ..... 378/136, 121, 378/119, 122, 137, 138

[56] References Cited

U.S. PATENT DOCUMENTS 4,730,353 3/1988 Ono et al. ..... 378/136 X 5,077,777 12/1991 Daly ..... 378/136

5,170,422 12/1992 Fiebiger ..... 378/136

*Primary Examiner*—David P. Porta

*Attorney, Agent, or Firm*—James J. Lichiello; John H. Pilarski

[57] ABSTRACT

X-ray tube electron beam focusing utilizing a cathode having a large cavity therein in which an electron cloud is generated and which is shielded from the primary electric field between the cathode and the anode. The electron cloud flows from the cavity through a small narrow passage and into the primary electric field. An opposed spaced apart pair of electrical grids each comprising an array of individual electrode segments have selected opposed segments electronegatively biased to change the cross-section of the passing electron stream therebetween. The altered cross-section of the electron stream determines the size of the focal spot of the electron beam impacting the target anode.

11 Claims, 2 Drawing Sheets

X-RAY TUBE ELECTRON BEAM FORMATION AND FOCUSING

This invention relates to improved x-ray tube electron beam formation and focusing, and more particularly to a method and means to vary the size of the focal spot of the impinging electron beam on the anode of an x-ray tube for improved system image quality, system performance and x-ray tube manufacturing.

BACKGROUND OF THE INVENTION

Ordinarily, an x-ray beam generating device, referred to as an x-ray tube, comprises dual electrodes of an electrical circuit in an evacuated chamber or tube. One of the electrodes is a thermionic emitter incorporated in a cathode assembly which is positioned in spaced relationship to a rotating disc-shaped target anode in the tube. Upon energization of the electrical circuit connecting the electrodes, the thermionic emitter is electrically heated to produce a supply of electrons which are appropriately accelerated and focused to a thin beam very high velocity electrons striking an annular section of the rotating disc anode. The annular section of the anode surface being struck by the electron beam comprises a surface of a predetermined material, a refractory metal for example, so that some of the kinetic energy of the striking electrons is converted to electromagnetic waves of very high frequency (x-rays). These electromagnetic waves proceed from the target anode, are collimated through an x-ray window in the surrounding tube wall and penetrate an object, such as human anatomic parts for medical examination and diagnostic procedures.

As is well known in x-ray practices, x-rays from the structure as described are caused to pass through the object to be examined and then impinge on an image detector, such as a solid state detector, a photographic film or plate, etc.. to provide an accurate visual representation of certain internal features of the object or anatomy. A high degree of resolution in the image obtained by this procedure is significant and necessary, particularly in medical practices for correct diagnosis. Consistent and improved image quality is influenced by a number of variables in x-ray tube design and operation. For example, the size of the focal spot of the impinging electron beam on the anode is a key contributor to x-ray image quality. From a number of x-ray image operations, it is noted that as the size of the focal spot increases, image resolution decreases. However, for a given x-ray tube electric power level, as the size of the focal spot decreases, the temperature of the impact region on the disc sharply increases, leading to decreased x-ray tube life expectancy. Accordingly, the design or selection of focal spot sizes is a compromise of required image quality and tube life.

It is an important object of this invention to provide an adjustable or variable focal spot size in an x-ray tube for improved image quality while maintaining desired tube life expectancy.

SUMMARY OF THE INVENTION

The cathode of an x-ray tube includes a hollow cavity therein in which a thermionic emitter generates an electron cloud. A negative biased electrode moves the electron cloud through a small passage out of the cavity into the primary electric field of the x-ray tube between the cathode and the anode. Opposite walls of the passage are fitted with electrical grid plates comprising a plurality of individual electrode segments exposed to the passing electron cloud or stream in the passage. When opposite grid plates are negatively biased, the size or cross-section of the passing electron cloud in the passage is altered. It is this altered size or cross-section of the electron stream entering the primary electric field which determines the focal spot size of the electron beam impacting the anode.

This invention will be better understood when taken in connection with the following drawings and description.

DESCRIPTION OF A PREFERRED EMBODIMENT

Figure 1:
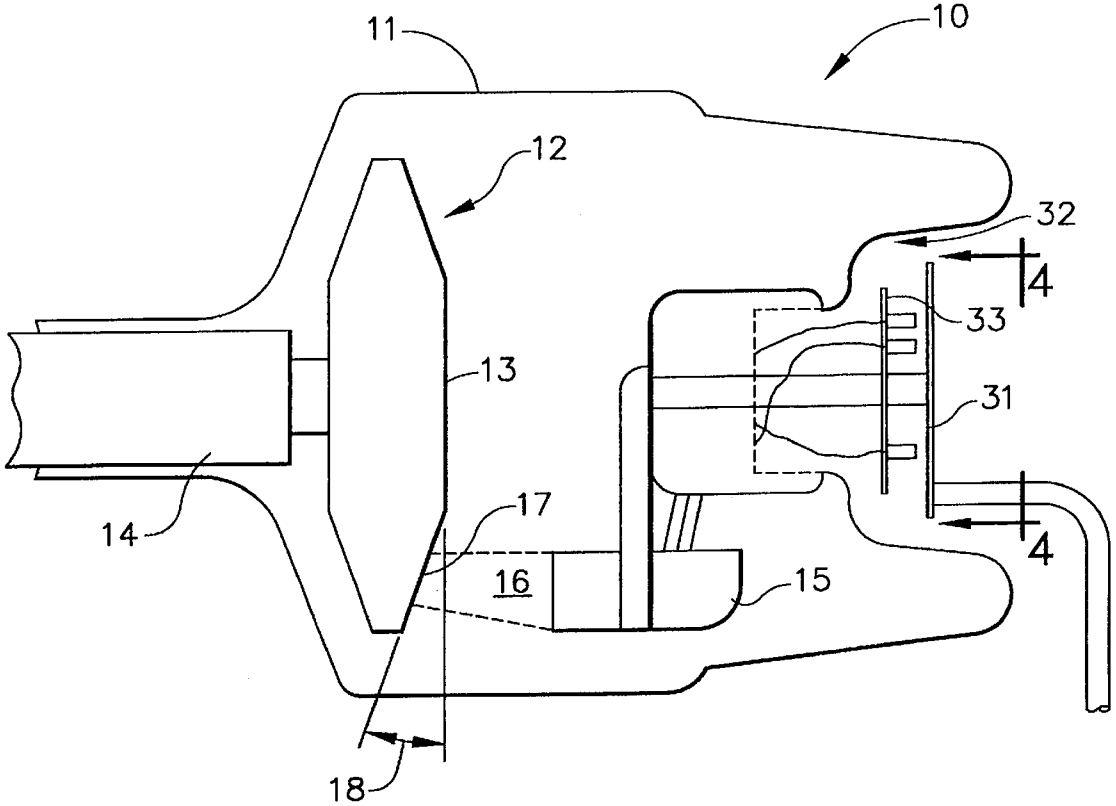
FIG. 1 is a schematic partial illustration of an x-ray tube insert and its major x-ray generating components.

Referring now to FIG. 1, the major components of an x-ray tube insert 10 include an evacuated vacuum envelope 11 having a rotating anode assembly 12 therein. Anode assembly 12 includes a target 13 mounted for rotation on an electric induction motor rotor 14. Positioned in spaced relationship to disc 13 is a themionic emitter cathode unit 15 which, when connected to an electrical circuit (not shown) generates and focuses a beam of electrons 16 striking disc 13 on its annular focal track surface 17 with a focal spot size and geometry dependent on the physical geometry of the cathode 15, as well as the operating tube current and voltage. The resulting x-rays, some of which are illustrated in FIG. 1 in a general representation as 18, pass from the focal track 17 through the vacuum envelope 11 to be utilized for the described x-ray purposes. Assembly 10 of FIG. 1 is described as an insert or subassembly which is mounted in a casing, a combination referred to as a tube unit.

In the assembly 10 as described, cathode 15 is usually designed to provide a thin rectangular cross-section electron beam 16 having a thin rectangular focal spot or footprint on target 13.

It is desirable to correlate the focal spot size to the available anode power loading limit so that image quality and x-ray tube life may be optimized. For these purposes, cathode 15 incorporates a primary focusing electrode as illustrated in FIG. 2.

Figure 2:
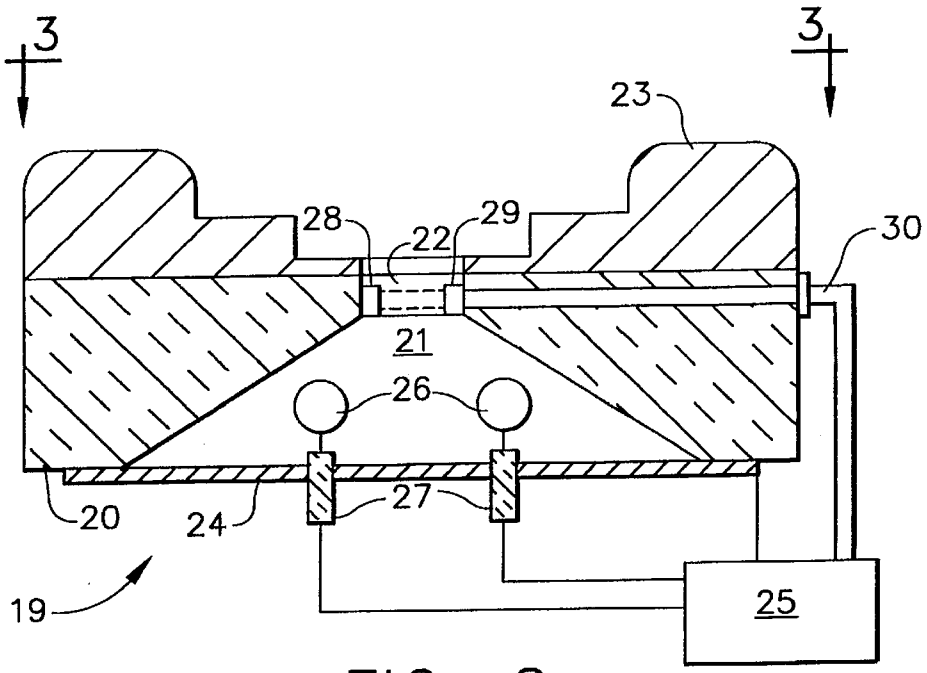
FIG. 2 is a cross-sectional view of one cathode assembly of this invention for use in the FIG. 1 insert.

Referring now to FIG. 2, focusing cathode assembly 19 comprises a generally short cylindrical member 20 of a good electrical insulating and high temperature resistant material such as a ceramic. Member 20 includes a large hollow cavity 21 therein with a sole, small rectangular exit passage 22 leading directly from cavity 21 and member 20. For convenience, member 20 may be described as a short cylindrical member having opposed faces, one of which incorporates a frustoconical cavity 21 and the other of which incorporates a narrow rectangular cross-section passage 22 at the smaller end of frustoconical cavity 21 and described as the sole exit passage leading from cavity 21. An annular electrode member 23 fits concentrically on cavity member 20 so that egress from cavity 21 through passage 22 as well as through annular member 23 is unobstructed. Member 23 is connected by an appropriate electrical conductor (not shown) to a source of electric power and serves as the principal electrode to establish a primary electric field between cathode assembly 19 and anode 13 (FIG. 1). A further electrode member 24 extends across cavity 21 opposite passage 22 and serves as a negatively biased forcing field electrode for focusing electrode assembly 19. Forcing field electrode 24 is connected to electric power supply 25 and given an electric negative bias to accelerate electrons out of cavity 21 through passage 22 and into the primary anode-cathode electric field. A supply of electrons in cavity 21 is provided by thermionic emission means such as from one or more thermionic filaments in cavity 21. In one example, as illustrated in FIG. 2, a pair of thermionic filaments 26 pass separately through individual electric insulators 27 in electrode 24 to be connected to electric power supply 25 for electrical resistance heating and electron emission in cavity 21. As illustrated in FIG. 2, thermionic filaments 26 are positioned between forcing field electrode 24 and passage 22. The position of electrode 24 may be described as adjacent the thermionic filaments where its negative electrical bias will have an immediate and direct affect on electrons in cavity 21 to accelerate them through passage 22. In this connection a further grid or mesh electrode may be positioned between passage 22 and filaments 26 to have an appropriate positive electric bias to aid in accelerating electrons through passage 22 into the primary electric field. With cathode assembly 19 of this invention being a replacement for cathode 15 of FIG. 1, the exiting electron cloud from passage 22 is caught up in the primary field between cathode assembly 19 and anode 13 to become electron beam 16.

An important advantage of this invention is that the supply of electrons for beam 16 is generated in an isolated or shielded location removed from deleterious effects of the primary electrical field, i.e. in cavity 21 of focusing cathode unit 19.

The described arrangement is particularly adaptive to electron control means for changing the shape of electron beam 16 (FIG. 1). For example, electrons moving out of cavity 21 must pass through passage 22 where electric fields are generated to initially form the passing electrons into a beam of desired length and width cross-section to be accelerated by the primary electric field to strike anode 13 (FIG. 1). Electron beam forming or control in passage 22 is provided by means of electron control plates referred to as grid plate electrodes and positioned on opposite walls of passage 22 as illustrated in FIG. 3.

Figure 3:
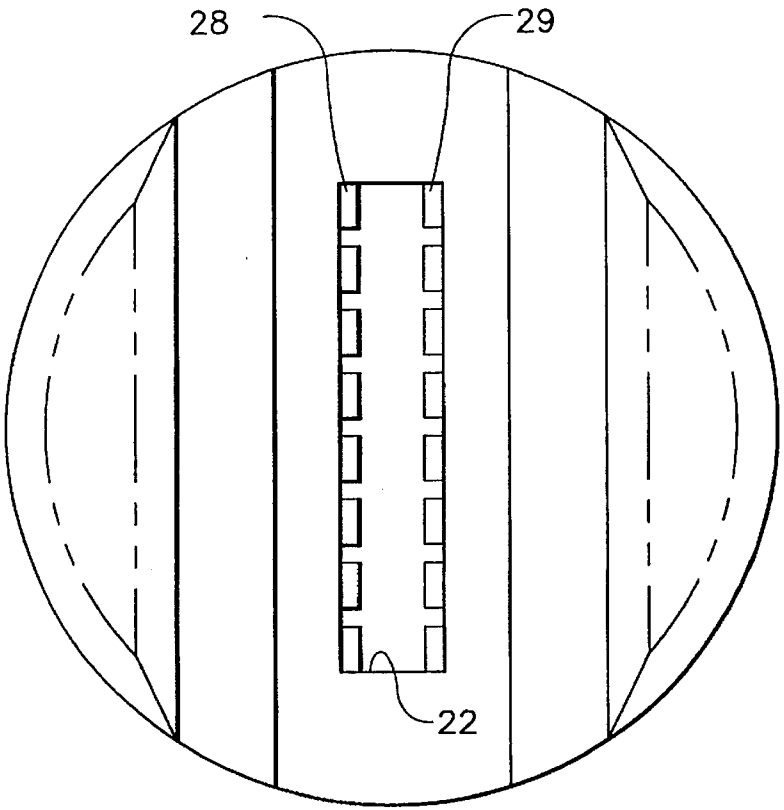
FIG. 3 is a top view of FIG. 2 taken along the line 3—3.

Referring now to FIG. 3, opposed walls of passage 22 are fitted with a grid plate electrode, i.e. a grid plate 28 on one wall and a corresponding grid plate 29 on an opposite wall. Each grid plate electrode comprises a plurality of individual electrode segments electrically insulated from each other. For example, in FIG. 3 passage 22 contains sixteen separate electrode segments, eight in each opposite plate 28 and 29. Each grid plate is positioned in mirror image relationship to its opposite grid with their individual electrode segments in registry opposed relationship. Each electrode segment is fitted with its own electrical conductor (not shown) which passes from each electrode segment in grid plates 28 and 29 to cable 30 and then to electrical power source 25. Electrical power source 25 includes appropriate control means so that opposite grid plates may be given a controlled electric negative bias voltage to change the shape of the cross-section of the passing electron stream in passage 22. The electron stream cross-section which exits from passage 22 into the primary electric field is not fixed by the physical wall structure defining passage 22 but, having entered passage 22 from sheltered cavity 21, is controllably affected by electric negative biasing voltage applied to selected pairs or all plate electrode segments of opposed plates.

By means of this invention an electron cloud is generated in a location shielded from the primary electric field, then formed to a preferred cross-section size, and subsequently accelerated into the primary electric field as the electron beam of an x-ray tube to impinge on a target anode with a focal spot which supports good x-ray image quality and x-ray tube life. Moreover, the focal spot size may be altered to accommodate different power levels of the x-ray tube while optimizing image quality.

Manufacture of x-ray tubes is facilitated by having certain parts pre-assembled in sub units which are common to a class of x-ray lubes. For example, a common cathode assembly may be fired to a tube class where the cathode assembly provides a predetermined result for all tubes of that class. For example, in FIG. 1, insert 10 is assembled into a metal casing resulting in an x-ray tube assembly. In the present invention, where focal spots may be changed, the number of different inserts required for a class of x-ray tube assemblies is significantly decreased. Also, the large number of cathode parts required for a class of x-ray tube inserts for different applications is significantly reduced. Moreover, the focal spot size may be adapted to the desired application and where the overall system, power level for a particular application is decreased, the focal spot size may be proportionately decreased, improving image quality. Accordingly, the smallest focal spot size may be employed to yield the highest image quality without damage to the focal track due to instantaneous power loading.

Electrical power supply and control for this invention generally follows known principles and equipment. For example, the usual power supply for an x-ray tube includes a suitable source of electrical power (not shown) connected to a transformer which supplies current to thermionic filaments 26 (FIG. 2). Potential for both the forcing field electrode 24 (FIG. 2) and the grid plates 28 and 29 (FIG. 3) is obtained by control electronics using the electrical current supplied by the transformer to filaments 26. Electrical power for principal electrode 23 is also taken from the noted suitable source of electrical power through an appropriate conductor (not shown). A number of bias supplies are utilized, such as a separate bias supply for each electron control plate. Bias supply is conveniently assembled in a small package and attached to a control panel 31 fixed to an exposed external section 33 (FIG. 1).

Figure 4:
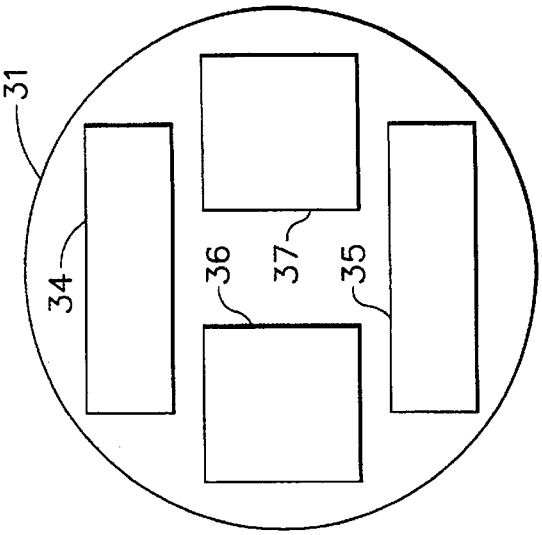
FIG. 4 is a frontal view of FIG. 1 taken along the line 4—4 illustrating a control circuit panel for the components of FIG. 1 slightly exaggerated for the purposes of clarity.

As illustrated in FIG. 1, a control panel 31 is suitably supported in an exposed section 32 of insert 20, together with an adjacent connector panel 33 which includes electrical connectors for the electrical components as illustrated in FIG. 4.

Referring now to FIG. 4 which is a view of FIG. 1 taken along the line 4—4 and somewhat exaggerated for the purpose of clarity, elongated rectangular component box 34 represents the entry connection for an electrical power source for the x-ray tube. Elongated rectangular component box 35 which is vertically spaced (from the perspective of the viewer) represents a receiver connection for input from the system. Such signals from a system protocol or program may be delivered to the x-ray tube in a digitized form to initiate rapid and effective response by the appropriate components such as forcing field electrode 24, FIG. 2, and plates 28 and 29, FIG. 3. Between boxes 34 and 35 are control and drive components 36 and 37 which are the bias supplies for plates 28 and 29 and are connected to a source of electrical power 25 (FIG. 2) to provide a separately controlled negative voltage bias for plates 28 and 29 (FIG. 3). Placement of these components for focal spot size control in their own separate regions, e.g. control panel 31 on the insert 10 inside the x-ray tube unit is a distinct advantage for size, cooling and high voltage management. All components on control panel 31 are maintained at cathode potential.

This invention provides an improved electron beam focusing system for x-ray tube applications. A particular cathode unit as described herein is a principal component of the system. The cathode includes means both to generate an electron cloud shielded from the primary electric field, as well as means to change the cross-section of the electron beam produced by the cathode. Increased manufacturing capability and a resultant decrease in the number of cathode designs required are further advantages for x-ray tube production.

The described invention defines a method of controlling the focal spot size of an x-ray tube electron beam impacting the x-ray tube target anode. Three basic features or steps comprise the defined method as follows:

1. Generating an electron cloud or supply in a region or space within the tube which is shielded from deleterious effects of the primary electric field. This feature is advantageously incorporated in a provided space within the cathode of the primary electric field.
2. Passing or accelerating a steam of electrons from the electron cloud or supply through a small passage and into the primary electric field to impact the anode. The focal spot or footprint size of the impacting electron beam on the anode is based on or determined by the cross-sectional shape of the passage. However, this focal spot may be controllably varied by
3. subjecting the electron stream in the passage to electric negative bias voltage on opposed electrodes in the passage to form a desired cross-section in the stream when passing between the electrodes. Thereafter, the stream is accelerated into the primary electric field to impact the anode with a focal spot size dependent on the size of the stream cross-section in the passage.

The unique result of these features is the fine control of focal spot size by electric control of the negative bias voltage on the electrodes in the described small passage, and by virtue of these features a common structure, e.g. cathode 19 can provide various focal spots through variable control parameters for a class of x-ray tubes.

While this invention has been disclosed and described with respect to a preferred embodiment, it will be understood by those skilled in the art that various changes and modifications may be made without departing from the spirit and scope of the invention.

What is claimed:

1. An electron focusing cathode for x-ray tubes wherein a primary electric field is established between a cathode and a spaced anode, said cathode comprising in combination (a) an insulating material cavity member having a large cavity therein and a small narrow exit passage leading from said cavity, (b) a principal electrode on said cavity member to establish a primary electric field between said cathode and said anode, (c) thermionic emissive cathode means to generate an electron cloud in said cavity, (d) forcing field electrode means adjacent said thermionic emissive means and connected to a source of electrical negative biasing voltage with respect to said thermionic emissive means to move said electron cloud from said cavity through said narrow exit passage, (e) opposite grid plate electrode means in said narrow exit passage and connected to a source of electrically negative biasing voltage with respect to said primary electric field cathode to change the cross-section of said electron cloud passing therebetween into said primary electric field.

2. The invention as recited in claim 1 wherein said forcing field electrode extends across said cavity opposite to said exit passage.

3. The invention as recited in claim 1 wherein said thermionic emissive means is positioned within said cavity between said forcing field electrode and said exit passage.

4. The invention as recited in claim 1 wherein said plate electrodes each comprise an array of individual electrode segments electrically insulated from each other.

5. The invention as recited in claim 1 wherein each said forcing field electrode means and said plate electrode means are connected to the same electrical power supply.

6. The invention as recited in claim 1 wherein said large cavity is frustoconical with said narrow exit passage at the smaller end thereof.

7. The invention as recited in claim 4 wherein said plate electrodes are positioned along opposite walls of said exit passage and aligned so that one is a mirror image of the opposite one.

8. In an x-ray tube comprising a spaced apart thermionic emissive cathode and an anode connected to a source of electrical power to provide a primary electric field extending therebetween to generate an electron beam from said cathode to strike said anode and produce x-rays emanating from said anode, an electron beam focusing cathode assembly therefore comprising in combination (a) an electrically insulating material cavity member having opposite faces thereon, (b) one of said faces incorporating a large hollow cavity in said cavity member, (c) the opposite of said faces incorporating a small narrow passage therethrough leading from said large cavity, (d) a principal electrode on said cavity member to establish a primary electric field between said cathode and said anode, (e) a plurality of thermionic emissive filament elements in said large cavity between said forcing field electrode and said narrow passage, (f) said thermionic emissive filament elements each having electrical conductor means passing through and electrically insulated from said forcing field electrode, (g) electron control grid plate means in said narrow passage in opposed spaced apart relationship and attached to opposed walls in planar to planar relationship to define a narrow rectangular electron grid channel passage from said large cavity, (h) a source of electric power connected to said thermionic filament elements and to said forcing field electrode in said cavity to cause an electron cloud to form in said cavity and exit through said narrow rectangular passage therein, (i) said source of electric power connected to said forcing field electrode for electrical negative biasing thereof to move said electron cloud through said exit channel passage, (j) electrical power control means to negatively bias said opposed electron control grid plate means negatively with respect to said principle electrode to change the cross-section of said electrons moving through said exit passage.

9. The invention as recited in claim 8 wherein said principal electrode is an annular member positioned concentrically on said cavity member for free egress of said electron cloud from said large hollow cavity through said small narrow passage and said principle electrode annular member.

10. The invention as recited in claim 8 wherein said tube comprises a hollow vacuum envelope with said cathode assembly and said anode therein in spaced apart relationship, and an electrical control panel attached to said envelope, said control panel comprising (a) electrical connector means for connection of a source of electrical power to said insert for electrical operation thereof, (b) separate electrically negative biasing supply means for each of said electron control grid means, and, (c) connection means for connection of a cable to said tube to transmit digital signals into appropriate receivers in said tube to control electrical power to said cathode assembly and said electron control grid plates.

11. In an x-ray tube, a method of varying the focal spot size of an electron beam from a cathode impinging on a spaced anode wherein said cathode and said anode are connected to a source of electric power to generate the x-ray tube primary electric field in which an electron beam from said cathode impinges said anode comprising (a) generating an electron supply in the x-ray tube shielded from the said primary electric field, (b) passing a stream of said electrons from said electron supply through a small rectangular cross-section passage into said primary electric field to impact said anode with a focal spot configuration on said anode representative of the cross-section of said passage, (c) subjecting said stream of electrons in said passage to opposed spaced apart electrodes having an electric negative bias voltage thereon with respect to said cathode to form a predetermined cross-section in said stream whereby the stream enters said primary electric field and impacts said anode with a focal spot size which is predicated by said predetermined cross-section.

* * * * *